United States Patent [19]

Ishikawa et al.

[11] 4,104,864

[45] Aug. 8, 1978

[54] ELECTRONIC TIMEPIECE

[75] Inventors: Takehiro Ishikawa; Kazumasa Yasuda; Kazuhiro Asano; Takashi Ishijima, all of Tokyo, Japan

[73] Assignee: Kabushiki Kaisha Daini Seikosha, Japan

[21] Appl. No.: 739,855

[22] Filed: Nov. 9, 1976

[30] Foreign Application Priority Data

Nov. 11, 1975 [JP] Japan ..... 50-135565

[51] Int. Cl.[2] ..... G04F 10/04; G04B 19/22; G04F 7/04

[52] U.S. Cl. ..... 58/39.5; 58/42.5; 58/74

[58] Field of Search ..... 58/39.5, 74, 42.5, 43, 58/44

[56] References Cited

U.S. PATENT DOCUMENTS 3,795,099 3/1974 Tsuruishi ..... 58/74

*Primary Examiner*—Edith S. Jackmon

*Attorney, Agent, or Firm*—Robert E. Burns; Emmanuel J. Lobato; Bruce L. Adams

[57] ABSTRACT

An electronic timepiece comprising in combination: the first and secondary time counters, each having the function of 2, 4 hour measuring, which measures the signal of frequency which will be the basis for time measurement; the chronograph, having the function of 24 hour measuring to make the time measurement by measuring the signal of frequency which will be the basis for the above mentioned time measurement; and the display selecting circuit for displaying each enumerated data of the above mentioned first and secondary time counters and the chronograph selectively by the display device.

1 Claim, 8 Drawing Figures

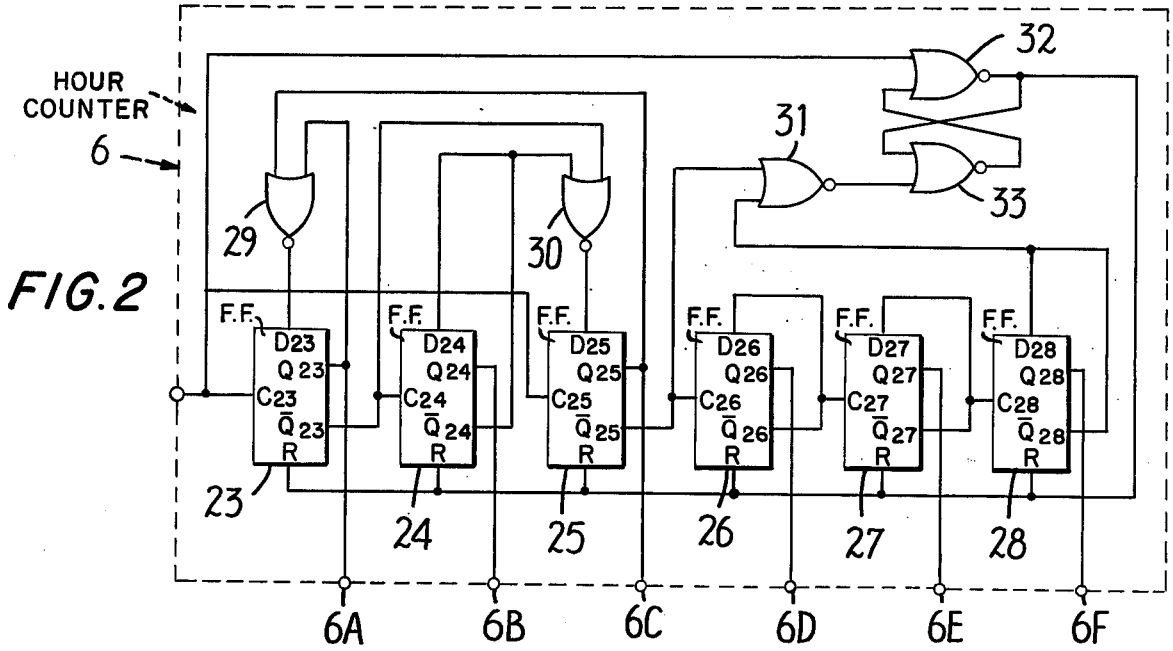
FIG. 2
FIG. 3
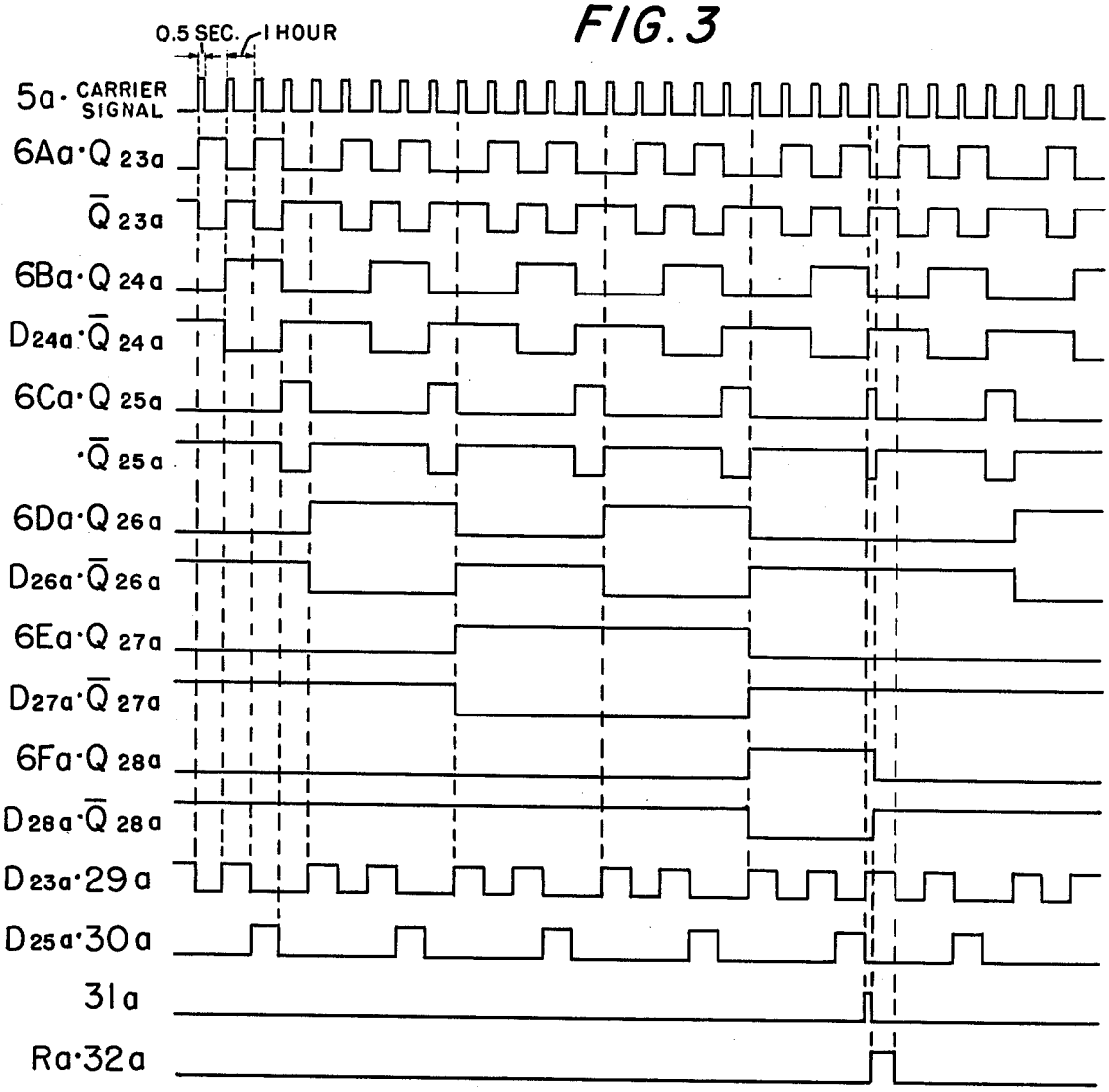

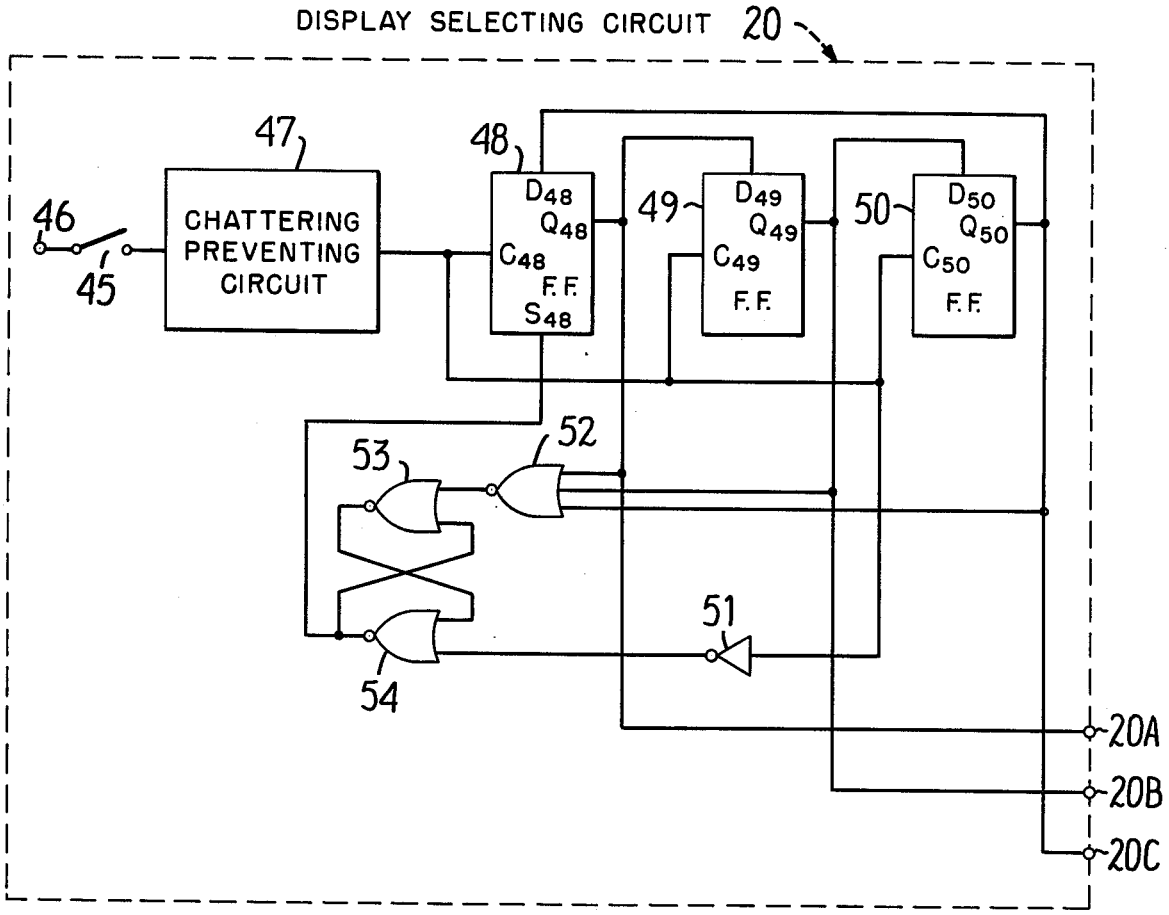
FIG.6
FIG.7
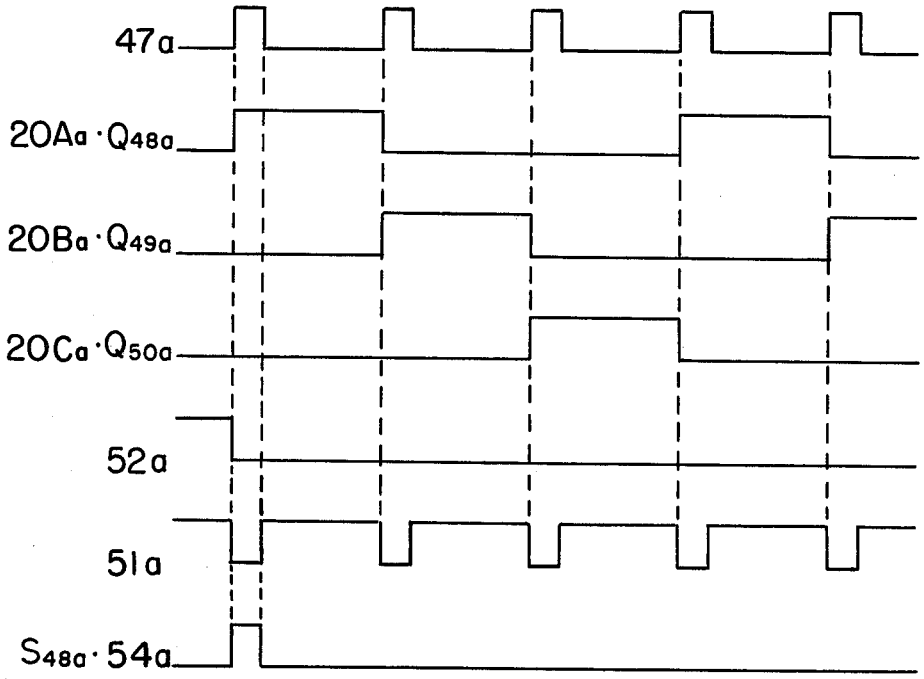

ELECTRONIC TIMEPIECE

DETAIL DESCRIPTION OF THE INVENTION

This invention covers an electronic timepice in which the diversification of function of timepiece is carried out.

While an electronic timepiece is equipped with highly integrated time measuring circuit and the display device to display time in response to the output of the watch circuit, the time measuring circuit has become very small in size with the advancement of IC technology and surplus space has come to occur inside of watch. In view of such, the utilization of this surplus space, for instance, to provide a function for displaying the time of a certain region other than the time of own country, to have the function as chronograph or to attempt to diversify the function as electronic timepiece will be very useful for users. On the other hand, in case of a watch where the times of certain fixed regions can be displayed as described above, the distenction of AM and PM will become difficult if it is of the 12 hour display.

Consequently, 24 hour display will become necessary in such case.

Therefore, this invention is for producing an electronic timepiece, with diversification of functions as a timepiece, embodying the first and secondary time counters, which have 24 hour measuring function and chronograph, where the time of the user's own country is measured by one of the time counters and the time of certain other region is measured by the other time counter while the fixed time measurement is made by the chronograph and having the result of these measurements displayed selectively by the display device. The detail explanation is made in the following, based on the embodiment illustrated by figures.

EXPLANATION OF THE DRAWINGS

FIG. 2 is the circuit diagram which shows a concrete example of the hour counter of 24 counter which constitutes the first time counter shown in FIG. 1;

FIG. 3 is the waveform diagram for explaining the action of the circuit, shown in FIG. 2;

FIG. 6 is the circuit diagram which shows a concrete example of the display selecting circuit, shown in FIG. 1;

FIG. 7 is the wave-form diagram for explaining the action of the circuit shown in FIG. 6.

3—the first time counter which has 24 hour measuring function.

6—the hour counter of 24 counter which constitutes a part of the first time counter.

7—the secondary time counter which has 24 hour measuring function.

10—the hour counter of 24 counter which constitutes a part of the secondary time counter.

12—the chronograph which has 24 hour measuring function.

13—the control circuit which constitutes a part of the chronograph.

16—the hour counter of 24 counter which constitutes a part of the chronograph.

17 to 19—gate circuits.

20—the display selecting circuit.

22—the display device.

23 to 28—the flip-flop circuit which constitutes a part of the hour counter of 24 counter.

37 to 39—the flip-flop circuit which constitutes a part of the control circuit.

48 to 50—the flip-flop circuit which constitutes a part of the display selecting circuit.

Figure 1:
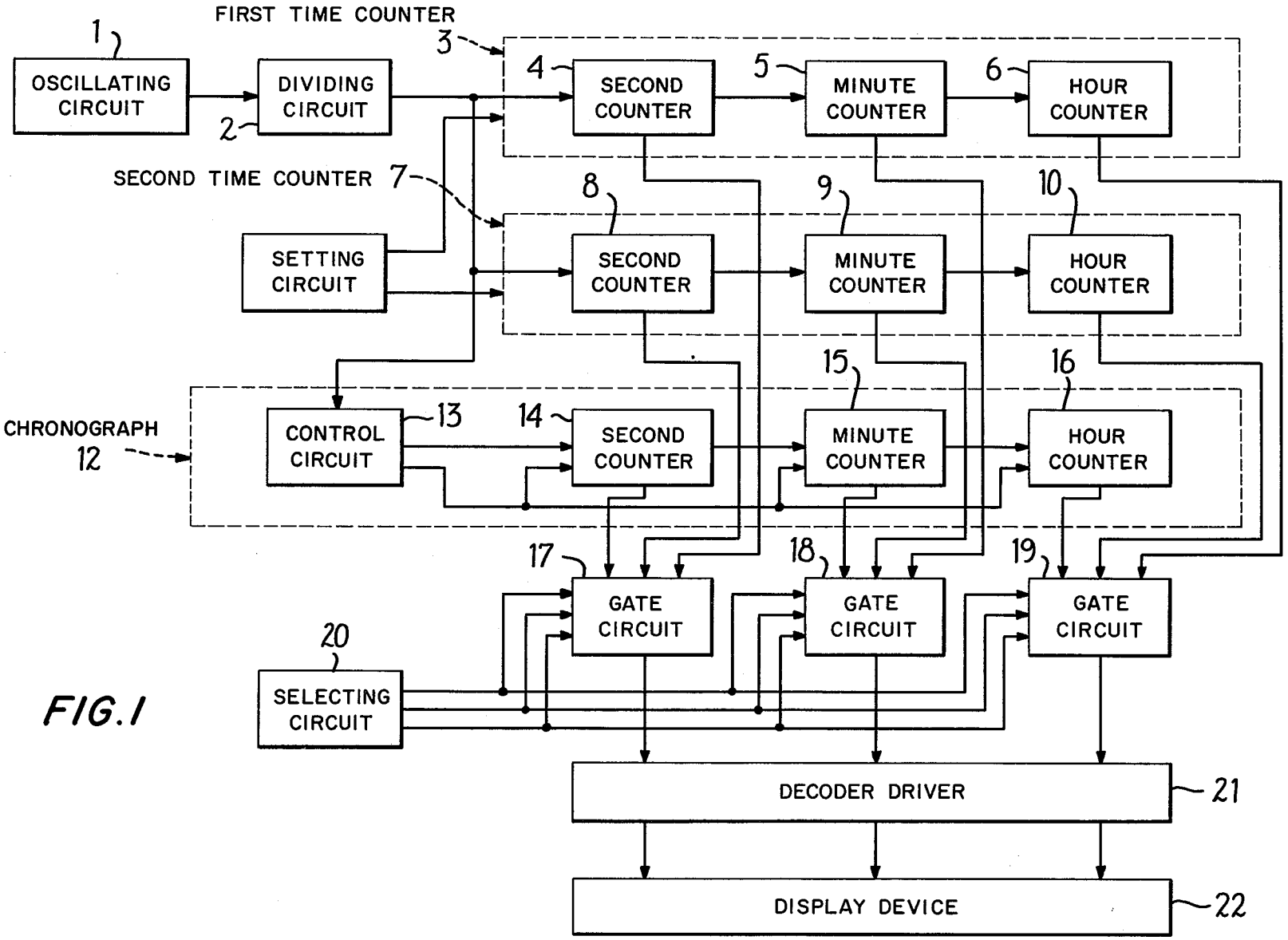
FIG. 1 is the block diagram which shows the system of the electronic timepiece covered by this invention.

FIG. 1 is a block diagram which shows the system of an electronic timepiece of this invention: and the numerical symbol 1 denotes the oscillating circuit which generates comparatively high frequency signal, by use of a solid vibrating element. The oscillating signal produced by the oscillating circuit is divided to the standard signal of frequency (1Hz in case of this example) which is to be the standard for the time measurement, by the frequency dividing circuit 2 comprised of multiple frequency dividing steps. The standard signal given out from the frequency dividing circuit 2 is fed to the first time counter 3 comprised of the second counter 4 of 60 counter made up of counters of 10 counter and 6 counter, the minute counter 5 of 60 counter made up of 10 counter and 6 counter and the hour counter 6 of 24 counter and also fed to the secondary time counter 7 comprised of the second counter 8 of 60 counter made up of counters of 10 counter and 6 counter, the minute counter 9 of 60 counter made up of 10 counter and 6 counter and the hour counter 10 of 24 counter: and moreover, the said standard signal is also fed to the chronograch composed of the control circuit 13, the second counter 15 of 60 counter, the minute counter 15 of 60 counter and the hour counter 16 of 24 counter. And the time adjustment and setting of the above mentioned first and secondary time counters, 3 and 1, are made by the time adjusting and setting circuit 11.

The counting contents produced as BCD code, from the second counter 4 of the first time counter 3, mentioned above, is fed to the gate circuit 17 and the carrier signal is fed to the minute counter 5. The counting contents produced as BCD code, from the minute counter 5, is fed to the gate circuit 18 and the carrier signal is fed to the hour counter 6. The counted contents produced from the hour counter 6 is fed to the gate circuit 19.

The counting contents produced as BCD code from the second counter 8 of the secondary time counter is fed to the gate circuit 17 and the carrier signal is fed to the minute counter 9. The counting contents produced as BCD code from the minute counter 9 is fed to the gate circuit 18 and the carrier signal is fed to the hour counter 10. The counting contents produced by the hour counter 10 is fed to the gate circuit 19.

The control circuit 13, which constitutes the chronograph 12, controls, by the operation of a switch, the standard signal it receives and passes on to the second counter 14 and at the same time, generates the reset pulse to reset each of the counters, 14, 15 and 16, by the operation of the afore-mentioned switch. The standard pulse given out from this control circuit 13 is fed to the second counter 14: and the counting contents produced by the second counter 14 is fed to the gate circuit 17. The carrier signal of the second counter 14 is fed to the minute counter 15 and the counting contents produced by the minute counter is fed to the gate circuit 18. The carrier signal of the minute counter 15 is fed to the hour counter 16 and the counting contents produced by the hour counter 16 is fed to the gate circuit 19.

In the gate circuit 17, only one of the counting contents among the counting contents supplied from the second counters 4 and 8 of the above-mentioned first and secondary counters 3 and 7 and from the second counter 14 of the chronograph 12 is selected by the selecting signal from the display selecting circuit 20 and is fed to the decoder driver 21. Similarly, in the gate circuit 18, only one of the counting contents among the counting contents supplied from the minute counters 5, 9 and 15 of the first and secondary time counters 3 and 7 and the chronograph 12 is selected by the selecting signal mentioned above, and is fed to the decoder driver 21. In the gate circuit 19, only one of the counting contents, among the counting contents supplied from the hour counters 6, 10 and 16 of the first and secondary time counters 3 and 7 and the chronograph 12 is selected by the selecting signal mentioned above and is fed to the decoder driver 21. The one of the counting contents of the first and secondary time counters and chronograph, selected and fed to the decoder driver 21 is converted to a code signal, suitable for displaying of time and hour, by the display device 22. The display device 22 carries out the display operation according to the counting contents supplied.

FIG. 2 is a circuit diagram which shows one of actual examples the hour counter 6 of 24 counter which constitutes the first time counter 3 shown in FIG. 1 and the constitution of circuit of this hour counter 10 is identical to the hour counter 10 of 24 counter which constitutes the secondary time counter 7 and to the hour counter 10 of 24 counter which constitutes the chronograph 12.

The hour counter 6 of 24 counter, shown in FIG. 2 is a 6 bit counter having six flip-flops (hereinafter referred to as "FF") 23, 24, 25, 26, 27 and 28. The lower 4 bits, that is the output terminals, 6A, 6B, 6C and 6D, are for 1 hour digit output and the upper 2 bits, that is the output terminals, 6E and 6F, are for 10 hour digit output. The carrier signal, that is the 1 hour pulse, supplied from the minute counter 5 (FIG. 1) is fed to the clock terminals $C_{23}$ and $C_{25}$ of $FF_{23}$ and $FF_{25}$. Furthermore, this carrier signal is fed to one of the input terminals of NOR circuit 32. The output terminal $Q_{23}$ of $FF_{23}$ is connected to one of the input terminals of 2 input terminals of NOR circuit 22 of which output side is connected to the data terminal $D_{23}$ of $FF_{23}$ and the output terminal $Q_{23}$ is also connected to the output terminal 6A. The inverted output terminal $\overline{Q}_{23}$ is connected to the clock terminal $C_{24}$ of $FF_{24}$ and is also connected to one of two input terminals of NOR circuit 30, of which output side is connected to the data terminal $D_{25}$ of $FF_{25}$. The output terminal $Q_{24}$ of $FF_{24}$ is connected to the output terminal 6B and the inverted output terminal $\overline{Q}_{24}$ is connected to the data terminal $D_{24}$ and also to the remaining input terminal of NOR circuit 30.

The output terminal $Q_{25}$ of $FF_{25}$ is connected to the remaining input terminal of NOR circuit 29 and also to the output terminal 6C. The inverted output terminal $\overline{Q}_{25}$ is connected to the clock terminal $C_{26}$ and also to one of the input terminals of NOR circuit 31 with two input terminals.

The output terminal $Q_{26}$ of $FF_{26}$ is connected to the output terminal 6D. The inverted output terminal $\overline{Q}_{26}$ is connected to the data terminal $D_{26}$ and also to the clock terminal $C_{27}$ of $FF_{27}$.

The output terminal $Q_{28}$ is connected to the output terminal 6F and the inverted output terminal $\overline{Q}_{28}$ is connected to the data terminal $D_{28}$ and also to the remaining input terminal of NOR circuit 31.

The output side of NOR circuit 31 is connected to one of the input terminals of NOR circuit 33 with two input terminals and the output side of NOR circuit 33 is connected to the remaining input terminal of NOR circuit 32. The output side of NOR circuit 32 is connected to the remaining input terminal of NOR circuit 3B and also to every reset terminal R of $FF_{23}$ to $FF_{28}$. However, the output of each of $FF_{23}$ to $FF_{28}$ changes at the time of starting of feeding of signal to the clock terminal.

The action of the hour counter 6 of 24 counter of such formation is explained here by referring to the waveform diagram shown in FIG. 3. However, in FIG. 3, the waveform with a mark "a" suffixed to the numerical symbol given to each part of the circuit shown in FIG. 2 shows the voltage waveform of each corresponding part and the numerical symbol **5*a* denotes the carrier signal of cyclic period of 1 hour and pulse amplitude of 0.5 second given out from the minute counter 5 (shown in FIG. 1**).

Since, before the first pulse of the carrier signal, given out from the minute counter 5, comes to be applied, that is at the time after 0 hour before 1 hour, the output of $FF_{23}$ and that of $FF_{25}$ are both "logic 0". The output of NOR circuit 29 to be applied to the data terminal $D_{23}$ of $FF_{23}$ is "logic 1". Therefore, when the first pulse is given out from the minute counter 5, the output of $FF_{23}$ changes to "logic 1" and the inverted output changes to "logic 0" and along with these changes, the output of NOR circuit 29 changes to "logic 0". Since, on the other hand, the inverted output of $FF_{24}$ at the time of starting of pulse to be given out from the minute counter 5 is "logic 1", the output of NOR circuit 30 is "logic 0", due to this, the output of $FF_{25}$ remains as "logic 0" even when the above mentioned pulse comes to be applied.

Next, since the output of NOR circuit 29 is "logic 0", the output of $FF_{23}$ changes to "logic 0" when the second pulse is given out from the minute counter 5 and the inverted outupt changes to "logic 1". And in response to this change of the output of $FF_{23}$ from "logic 0" to "logic 1", the output of $FF_{24}$ changes to "logic 1", since the inverted output is "logic 1", and the inverted output changes to "logic 0" from "logic 1". On the other hand, the data terminal $D_{25}$ of $FF_{25}$ at the time when the above mentioned second pulse is applied, that is the output of NOR circuit 30, is "logic 0", the output of $FF_{25}$ remains "logic 0" as is.

Next, when the 3rd pulse is given out from the minute counter 5, the output of $FF_{23}$ changes to "logic 1" and the output of NOR circuit 29 changes to "logic 0". At this time, the data terminal $D_{25}$, that is the output of NOR circuit 30, changes to "logic 1" and the output of $FF_{25}$ does not change.

When the 4th pulse is given out from the minute counter 5, the output of $FF_{23}$ changes to "logic 0" and the inverted output changes to "logic 1". By these changes, the output of $FF_{24}$ changes to "logic 0" and furthermore, the output of $FF_{25}$ changes to "logic 1" for the first time.

Next, when the 5th pulse is given out from the minute counter 5, the output of $FF_{25}$ changes to "logic 0" while the output of $FF_{23}$ and that of $FF_{24}$ do not change. Consequently, the inverted output of $FF_{25}$ changes from "logic 0" to "logic 1" at this time and by these changes, the output of $FF_{26}$ changes to "logic 1" for the first time.

From the 6th pulse on to the 23rd pulse given out from the minute counter 5, the above described actions are repeated on $FF_{23}$ to $FF_{25}$, and the output of $FF_{26}$ changes at the instant when the inverted output of $FF_{25}$ changes from "logic 0" to "logic 1" and the output of $FF_{27}$ changes at the instant when the inverted output of $FF_{26}$ changes from "logic 0" to "logic 1". Furthermore, the output of $FF_{28}$ changes at the instant when the inverted output of $FF_{27}$ changes from "logic 0" to "logic 1". Therefore, the state of condition of output of each FF from 23 to 28 between the time when the 23rd pulse is applied from the minute counter 5 and when the 24 l pulse comes to be applied is that the output of $FF_{23}$ is "logic 1", the output of $FF_{24}$ is "logic 1", the output of $FF_{25}$ is "logic 0", the output of each of $FF_{26}$ and $FF_{27}$ is "logic 0" and the output of $FF_{28}$ is "logic 1", and the output of NOR circuit 29 is "logic 0" and the output of NOR circuit 30 is "logic 1", and the output of NOR circuit 31 to which the inverted output of $FF_{25}$ and the inverted output of $FF_{28}$ are applied is "logic 0" and the output of NOR circuit 32, to which the output of NOR circuit 33 and the pulse from the minute counter 5 are applied is "logic 0".

However, while the inverted output of $FF_{25}$ changes to "logic 0" when the 24th pulse is given out from the minute counter 5, the output of NOR circuit 31 changes to "logic 1" since the inverted output of $FF_{28}$ remains as "logic 0". By this change, the output of NOR circuit 33 changes to "logic 0". Consequently, the output of NOR circuit 32 becomes "logic 1" at the same time when the application of the 24th pulse comes to stop, that is at the time of starting of recession of the 24th pulse, and this output resets each of FF from 23 to 28. This output of NOR circuit 32, which resets each of FF from 23 to 28, changes to "logic 0" at the instant when the next pulse, the 25th pulse, has come to be applied, and the reset of each FF from 23 to 28 is released. The subsequent action is the repitition of the above described actions.

Thus, by having the output of each FF from 23 to 25 to be of output in counting contents of 1 hour digit and the output of $FF_{27}$ and that of $FF_{28}$ to be the output in counting contents of 10 hour digit, 24 hour measurement is carried out. Furthermore, though in $FF_{23}$ to 25, the output of counting contents is not made in the general BCD code, you can see that the changing of this code which is given out, for instance, into the display signal of seven segments can be made easily.

Figure 4:
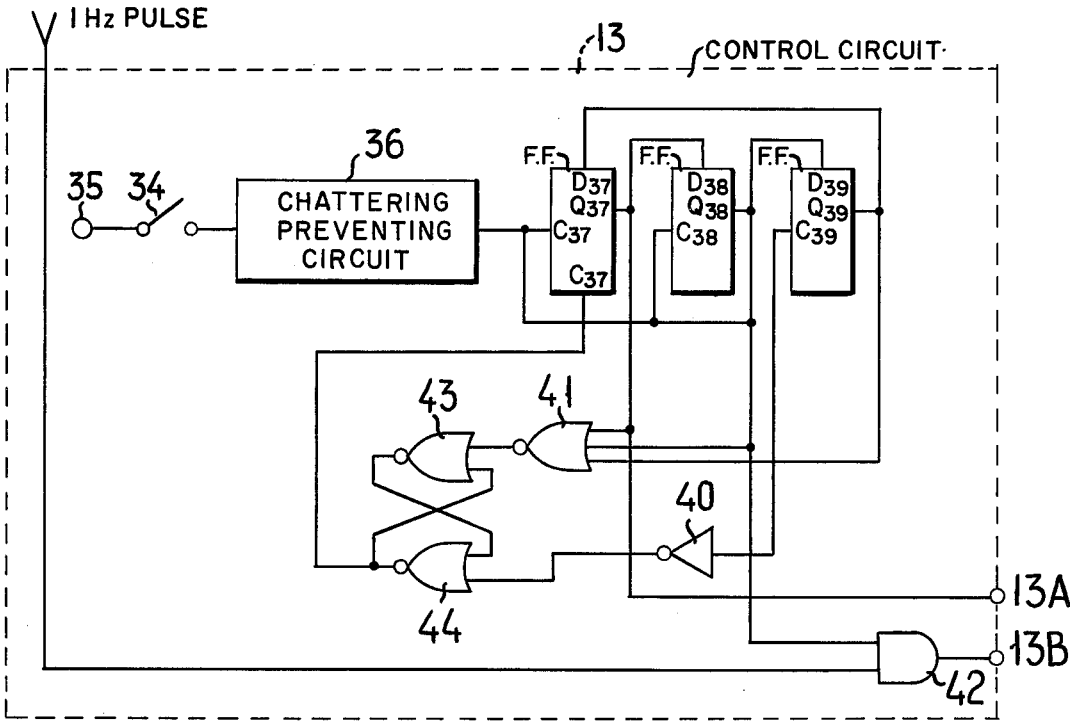
FIG. 4 is the circuit diagram which shows a concrete example of the control circuit which constitutes the chronograph, shown in FIG. 1.

FIG. 4 is a circuit diagram which shows one of the concrete examples of the control circuit which constitutes the chronograph 12, shown in FIG. 1 and the numerical symbol 34 is a manually operated switch to operate the chronograph. One end of this switch 34 is connected to a high tension terminal 35 of the power supply and the other end is connected to the input side of the chattering preventing circuit 36. The output side of the chattering preventing circuit 36 is connected to the clock terminals $C_{37}$, $C_{38}$ and $C_{39}$ of $FF_{37}$, $FF_{38}$ and $FF_{39}$ respectively and also to the input terminal of the inverter 40. The output terminal $Q_{37}$ of $FF_{37}$ is connected to the data terminal $D_{38}$ and also to one of the input terminals of NOR circuit 41 with 3 input terminals and to the output terminal 13A of reset signal (for resetting of each of the counters, 14, 15 and 16 of the control circuit 13. The output terminal $Q_{38}$ is connected to the data terminal $D_{39}$ of $FF_{39}$ and also to one of the input terminals of NOR circuit 41 and to one of two input terminals of AND circuit 42. The output terminal $Q_{39}$ of $FF_{39}$ is connected to the data terminal $D_{37}$ of $FF_{37}$ and also to the remaining input terminal of NOR circuit 41. The signal of 1Hz from the frequency dividing circuit 2 (shown in FIG. 1) is fed to the remaining input terminal of AND circuit 42 and this output is fed to the second counter 14 (shown in FIG. 1) through the terminal 13B.

And the output side of NOR circuit 41 is connected to one of two input terminals of NOR circuit 43 and the output side of NOR circuit 43 connected to one of the input terminals of NOR circuit 44 while the output side of the inverter 40 is connected to the other input terminal of NOR circuit 44. The output side of NOR circuit 44 is connected to one of the input terminals of NOR circuit 43 and also to the set terminal $S_{37}$ of $FF_{37}$.

Figure 5:
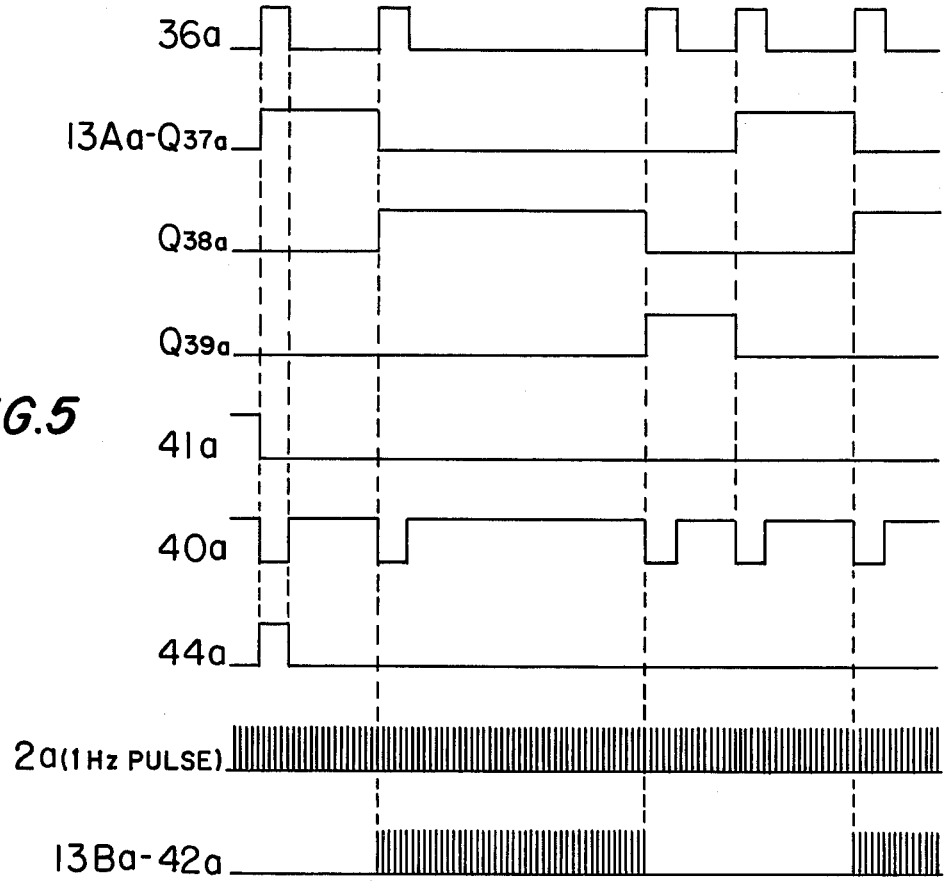
FIG. 5 is the waveform diagram for explaining the action of the circuit shown in FIG. 4.

The action of the control circuit of the chronograph of such construction is explained by referring to the waveform diagram shown in FIG. 5. However, in FIG. 5, the waveform with a mark "*a*" suffixed to the numerical symbol, given to each part of the circuit shown in FIG. 4 shows the voltage waveform of each corresponding part and the numerical symbol 2*a* denotes the pulse signal of 1Hz fed to AND circuit 42 from the frequency dividing circuit (shown in FIG. 1).

When the electric power is applied to entire time keeping circuit, including the control circuit 13, the output of each of $FF_{37}$, 38 and 39 is "logic 0". Therefore, the output of NOR circuit 41, to which the above outputs are supplied, is "logic 1". And before the switch 34 is operated, the output of the chattering preventing circuit 36 is "logic 0". Therefore, one of the input to NOR circuit 44 from the inverter 40 is "logic 1" and the output is "logic 0". Next, when the switch 34 is operated, one pulse is given out from the chattering preventing circuit 36 and at the same time, the output of NOR circuit 44 changes to "logic 1", and $FF_{37}$ comes to be set and its output changes to "logic 1". This output of $FF_{37}$ resets each of the counters 14, 15 and 16 (shown in FIG. 1), which constitute the chronograph 12 (shown in FIG. 1), through the output terminal 13A of the control circuit 13. Next, when the second pulse is given out from the chattering preventing circuit by the operation of the switch 34, the output of $FF_{37}$ changes to "logic 0" and at the same time, the output of $FF_{38}$ changes to "logic 1". Accordingly, a pulse signal of 1Hz is given out from the output of AND circuit 42 to which 1Hz pulse signal is fed to one of its input terminals. This signal is counted by each of the second, minute and hour counters, 14, 15 and 16 (shown in FIG. 1) which had been released from reset by the change of the output of $FF_{37}$.

Then when third pulse is given out from the chattering preventing circuit 36, by the operation of the switch, the output of $FF_{38}$ changes to "logic 0" and the output of 1Hz signal from AND circuit 42 comes to be stopped. Furthermore, by the above mentioned third signal, the output of $FF_{39}$ changes to "logic 1". Then when fourth pulse is given out from the chattering preventing circuit 36, by the operation of the switch, the output of $FF_{37}$ changes to "logic 1" because the data terminal $D_{37}$, that is the output of $FF_{39}$, "logic 1", even though the output of NOR circuit 44 remained as "logic 0". This output of $FF_{37}$ resets each of the counters, 14, 15 and 16 (shown in FIG. 1) in the similar manner as in case when the first pulse was given out, as described above, and the subsequent action makes the output of $FF_{38}$ and that of $FF_{39}$ "logic 1" in turns and repeats the above described actions.

FIG. 6 is a circuit diagram which shows a concrete example of the display selecting circuit 20, shown in FIG. 1 and the symbol 45 denotes a switch which is used for selecting the display of counting contents of any one of the first time counter, secondary time counter or chronograph (shown in FIG. 1). One end of this switch is connected to the high tension terminal 46 of the power supply and the other end is connected to the input side of the chattering preventing circuit 47. The output side of the chattering preventing circuit 47 is connected to each of the clock terminals, $C_{48}$, $C_{49}$ and $C_{50}$ of $FF_{48}$, 49 and 50 respectively and also to the input terminal of the inverter 51. The output terminal $Q_{48}$ of $FF_{48}$ is connected to the data terminal $D_{49}$ and to one of 3 input terminals of NOR circuit 52 and also to the first output terminal 20A of the display selecting circuit 20. The output terminal $Q_{49}$ is connected to the data terminal $D_{50}$ of $FF_{50}$ and to one of 2 remaining terminals of NOR circuit 51 and furthermore to the second output terminal 20B of the display selecting circuit 20. The output terminal $Q_{50}$ of $FF_{50}$ is connected to the data terminal $D_{48}$ of $FF_{48}$ and to the remaining input terminal of NOR circuit 52 and furthermore to the third output terminal 20C of the display selecting circuit 20.

On the other hand, the output side of NOR circuit 52 is connected to one of 2 input terminals of NOR circuit 53 and the output side of NOR circuit 53 is connected to one of the input terminals of NOR circuit 54, of which other input terminal is connected with the output side of the inverter 51. The output side of NOR circuit 54 is connected to the remaining input terminal of NOR circuit 53 and to the set terminal $S_{48}$ of $FF_{48}$.

The action of the display selecting circuit 20 of such construction is explained by referring to the waveform diagram shown in FIG. 7. However, in FIG. 7, the waveform with a mark "*a*" suffixed to the numerical symbol, given to each part of the circuit shown in FIG. 6 shows the voltage waveform of each corresponding part.

When the electric power is applied to entire timepiece circuit, including this display selecting circuit 20, the output of each of $FF_{48}$, 49 and 50 is "logic 0". Therefore, the output of NOR circuit 52, to which the output of each of $FF_{48}$, 49 and 50 is applied, is "logic 1". And before the switch 45 is operated, the output of the chattering preventing circuit 47 is "logic 0" and the output side of the inverter 51 is "logic 1". By this, it can be seen that the output of NOR circuit 54 is "logic 0". And when the switch is operated subsequently, the first pulse will be given out from the chattering preventing circuit 47 and the output of NOR 54 changes to "logic 1", at the same time. By this, $FF_{48}$ is set and its output becomes "logic 1". This output of $FF_{48}$ appears in the first output terminal 20A.

Next, when second pulse is given out from the chattering preventing circuit 47 by the operation of the switch 45, the output which is applied to the data terminal $D_{49}$, that is the output of $FF_{48}$, was "logic 1" condition, and the output of $FF_{49}$ comes to be "logic 1", and the output of $FF_{48}$ changes to "logic 0". The output of $FF_{49}$ appears at the second output terminal 20B.

Next, when third pulse is given out from the chattering preventing circuit 47 by the operation of the switch 45, the output which is applied to the data terminal $D_{50}$, that is the output of $FF_{49}$, was "logic 1" condition and the output of $FF_{50}$ comes to be "logic 1", and the output of $FF_{49}$ changes to "logic 0". The output of $FF_{50}$ appears at the third terminal 20C.

Next, when fourth pulse is given out from the chattering preventing circuit 47 by the operation of the switch 45, the output of $FF_{48}$ changes to "logic 1" because the output which is applied to the data terminal $D_{48}$, that is the output of $FF_{50}$, was "logic 1", in spite of the output of NOR circuit 50 being "logic 0". That is to say that the output of NOR circuit 54 does not act when the output of any one of $FF_{48}$ to 50 is "logic 1", and the subsequent action will be the same as that of the ring counter by $FF_{48}$ to 50, and the "logic 1" signal is supplied successively to the output terminals 20A to 20C.

Figure 8:
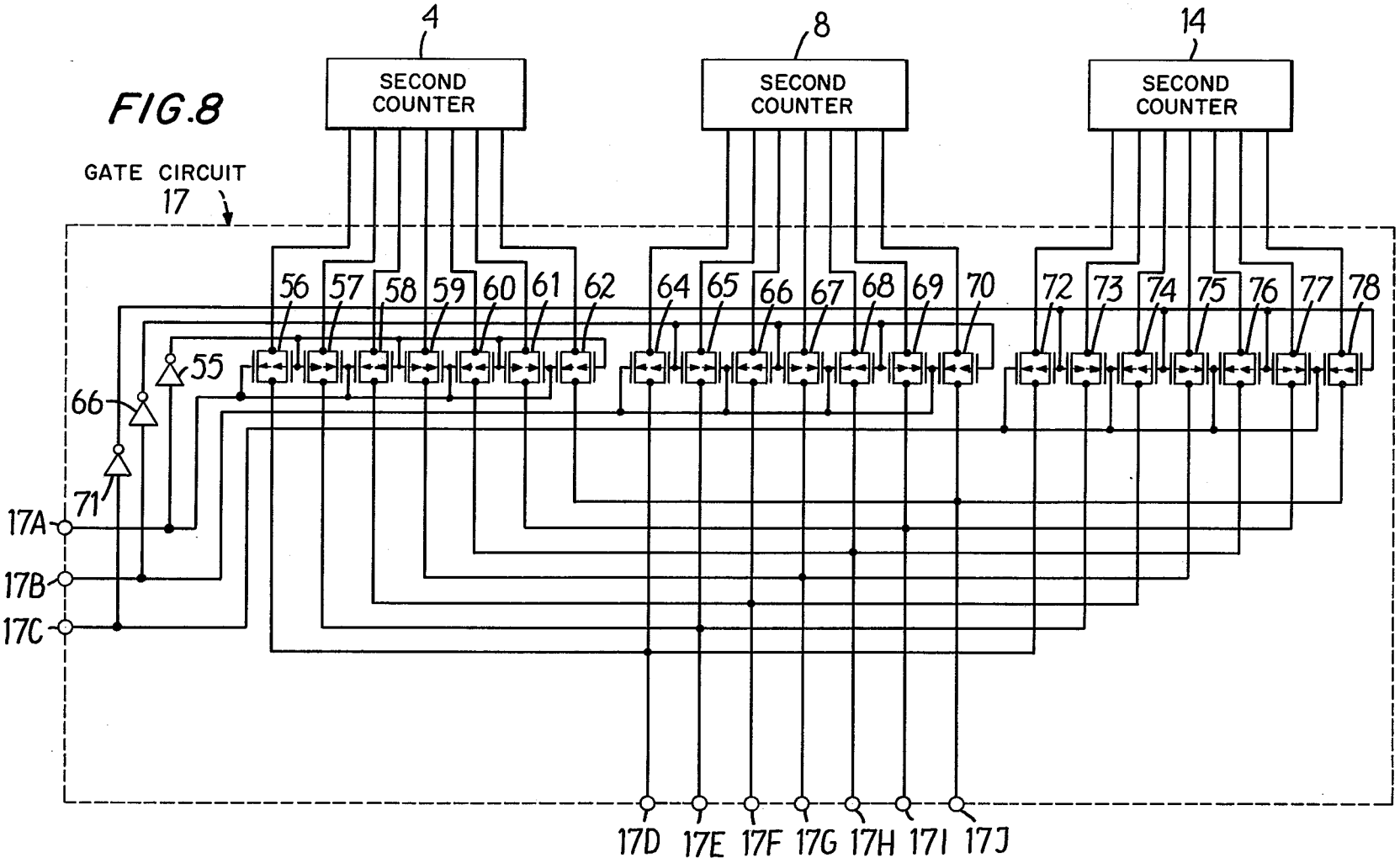
FIG. 8 is the circuit diagram which shows a concrete example, of the gate circuit, shown in FIG. 1.

FIG. 8 is a circuit diagram showing a concrete example of the gate circuit 17, shown in FIG. 1. Since the construction and action of other gate circuits 18 and 19, shown in FIG. 1, are same as those of the gate circuit 17, one circuit has been taken up for explanation.

The symbols 17A, 17B and 17C, shown in FIG. 8, are the input terminals corresponding to the output terminals of the display selecting circuit 20, and the first output terminal 20A of the display selecting circuit is connected to the input terminal 17A. The output terminal 20B is connected to the input terminal 17B and the output terminal 20C to the input terminal 17C. The above mentioned input terminal 17A is connected, through the inverter 55, to the gate electrode on P channel side of each of seven transmission gates (hereinafter reffered to as "TG") 56, 57, 58, 59, 60, 61 and 62. The input terminal 17A is also connected directly to the gate electrode on N channel side of TG 56 to 62. In the same way, the input terminal 17B is connected, through the inverter 63, to the gate electrode on P channel side of each of seven TG, 64, 65, 66, 67, 68, 69 and 70. The input terminal 17B is also connected directly to the gate electrode of N channel side of TG 64 to 70. Furthermore, the input terminal 17C is connected, through the inverter 71, to the gate electrode on P channel side of each of seven TG, 72, 73, 74, 75, 76, 77 and 78. The input terminal 17C is also connected directly to the gate electrode on N channel side of TG 72 to 78. The output of 7 bit of the second counter 4 of 60 counter, which constitutes the first hour counter 3 (shown in FIG. 1), is applied to each of TG 56 to 62. The output of 7 bit of the second counter 8 of 60 counter, which constitutes the secondary hour counter 7 (shown in FIG. 1), is applied to each of TG 64 to 70. Furthermore, the output of 7 bit of the second counter 14 of 60 counter, which constitutes the chronograph 12 (shown in FIG. 1), is applied to each of TG 72 to 78. The output side of each of TG 56, 64 and 72 is connected the output terminal 17D, the output side of each of TG 57, 65 and 73 is connected to the output terminal 17E, the output side of each of TG 58, 66 and 74 is connected to the output terminal 17F, the output side of each of TG 59, 67 and 75 is connected to the output terminal 17G, the output side of each of TG 60, 68 and 76 is connected to the output terminal 17H, the output side of each of TG 61, 69 and 77 is connected to the output terminal 17I, and the output side of each of TG 62, 70 and 78 is connected to the output terminal 17J. In the gate circuit 17 of such construction, when a signal of "logic 1" is applied to the input terminal 17A, TG 56 to 62 become all ON condition and the counting contents of the second counter 4 will be fed to the output terminals 17D to 17J. Next, when "logic 1" signal is applied to the input terminal 17B, TG 64 to 70 become all "ON" condition and the counting contents of the second counter 8 will be fed to the output terminals 17D to 17J. Furthermore, when "logic 1" signal is applied to the input terminal 17C, TG 72 to 78 all became "ON" condition and the counting contents of the second counter 14 will be fed to the output terminals 17D to 17J. However, since "logic 1" signal is fed successively to the input terminals 17A to 17C in response to the operation of the switch 45 of the display selecting circuit, shown in FIG. 6, there is no possibility that the counting contents of more than two counters will be fed to the output terminals 17D to 17J.

Thus, the counting contents of the counter selectively given out in response to the operation of the switch of the display selecting circuit 20 is fed, through the above mentioned output terminals 17D to 17J, to the decoder driver 21, shown in FIG. 1. And while the above mentioned gate circuit 17 is equipped with 7 TG corresponding to the number of output bits of each of the counters, 4, 8 and 14, the gate circuit 19 is equipped with 18 TG, 6 TG being used as a set, because the number of output bits of each counter of 24 counter, 6, 10 and 16, is 6.

Since the electronic timepiece, based on this invention, which has been explained above, referring to FIG. 1 to FIG. 8 is equipped with the first and secondary time counters 3 andd 7 and the chronograph 12, each having 24 hour measuring function, and it can display the counting contents on the display device 22 by having one of the counting contents selected by the display selecting circuit 20 (for example, if the first time counter 3 is set on Japan Standard Time and the secondary time counter 7 on Greenwich Mean Time (GMT), it is possible to know GMT instantly at any time by the operation of the switch 45 of the display selecting circuit 20 or if the display of the counting contents of the chronograph 12 is selected by the operation of the switch 45 of the display selecting circuit 20, it is possible to make the time measurement of compatively long length of time, such as an autorace, by the operation of the switch of the control circuit 13, it is possible to make three independent time measurements with one unit of timepiece and furthermore it also can be used for various purposes by suitably combining these time measuring funcitons.

Though the electronic timepiece of this invention has been described above in details referring to the actual examples by the diagrams, this invention is not limited only to the cases of examples shown by the diagrams but it is possible to have various changes or improvements made on it.

As described above, since the electronic timepiece of this invention is equipped with the first and secondary time counters and chronograph, each having 24 hour measuring function, and also the display selecting circuit which makes the display of the counting contents selectively on the display device (for example, the time of one's own country measured by the above mentioned first time counter and the time of a certain prescribed area measured by the secondary time counter can be known selectively by the display selecting circuit; and moreover, the judging of AM and PM, which is necessary in case of watch of 12 hour measurement, is not required and the time of the certain presceibed area can be known accurately; and furthermore, it is possible to make the time measurement of comparatively long length of time by selecting the display of the counting contents of the chronograph by the display selecting circuit), it had became possible to plan for diversification of functions as a timepiece and has fully achieved the planned aim and has come to be very effective in use.

We claim:

1. An electronic timepiece comprising, in combination: an oscillator circuit for generating a repetitive time standard signal having a repetition rate defining a time base; a dividing circuit connected to receive said time standard signal for dividing the same to develop a repetitive output signal having a repetition rate representing passage of time; a primary time counter of the 24 hour type connected for counting the output signal of said dividing circuit for developing a count representative of time and which advances with the passage of time; a secondary time counter of the 24 hour type connected for counting the output signal of said dividing circuit for developing a count representative of time and which advances with the passage of time; a third time counter of the 24 hour type comprised of a plurality of individual counters in cascade for counting the output signal of said dividing circuit; means for applying the output signal of said dividing circuit to selected ones of said counters comprising said third time counter at a certain time and for terminating application of the output signal of said dividing circuit to operate said third counter in a chronograph mode; a time correcting circuit cooperative with said primary and secondary time counters for setting the respective counts of said primary and secondary time counters; a display circuit responsive to the count of a respective one of said counters for displaying a time represented by the count; and time selecting means for selectively applying the count of a respective one of said counters to said display circuit for displaying a selected time and for operating the timepiece in a timekeeping mode or a chronograph mode.

* * * * *